US006277316B2

(12) United States Patent
Kistner et al.

(10) Patent No.: US 6,277,316 B2
(45) **Date of Patent: *Aug. 21, 2001**

(54) METHOD OF FORMING A PREFABRICATED WALL PANEL

(75) Inventors: Michael J. Kistner, East Amherst; Paul J. Rowe, Fairport, both of NY (US)

(73) Assignee: Kistner Concrete Products, Inc., East Pembroke, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/327,789

(22) Filed: Jun. 7, 1999

Related U.S. Application Data

(60) Division of application No. 08/508,722, filed on Jul. 28, 1995, now Pat. No. 5,956,911, which is a continuation-in-part of application No. 08/015,783, filed on Feb. 10, 1993, now abandoned.

(51) Int. Cl.[7] ..... B29C 39/10; B29C 39/28

(52) U.S. Cl. ..... 264/275; 264/229; 264/263; 264/276; 264/277; 264/333; 425/DIG. 127; 29/897.32

(58) Field of Search ..... 264/154, 277, 264/261, 263, 268, 274, 275, 276, 333, 229; 425/DIG. 127; 29/897.32

(56) References Cited

U.S. PATENT DOCUMENTS 3,373,479 * 3/1968 Watt et al. ..... 29/527.1
3,589,664 * 6/1971 Middlestadt ..... 404/89
3,775,922 * 12/1973 Myers ..... 52/367

FOREIGN PATENT DOCUMENTS

1516846 * 7/1978 (GB) ..... B28B/23/00

* cited by examiner

*Primary Examiner*—Jan H. Silbaugh
*Assistant Examiner*—Michael I. Poe
(74) *Attorney, Agent, or Firm*—Hayes, Soloway, Hennessey, Grossman & Hage, PC

(57) ABSTRACT

A method of forming a prefabricated insulated wall panel for installation with like wall panels for easily and inexpensively building a wall. The method includes the steps of providing a mold for casting a concrete member having a generally planar portion including an inner surface and an outer surface and a plurality of rib portions extending from the inner surface to an edge, nesting at least one insulation strip within a respective spring member so that the spring member extends about sides of the insulation strip and terminates in end portions which extend inwardly relative to the insulation strip sides, selecting the spring member to be biased against respective walls of a mold portion corresponding to a rib portion of the concrete member when the nested insulation strip is inserted therein, inserting the nested insulation strip in the mold portion, and casting the concrete member in the mold with the insulation strip and the spring member unitarily attached to a rib portion edge of the concrete member with the end portions of the spring member anchored in the concrete member to make a wall panel.

14 Claims, 4 Drawing Sheets

FIG. 1
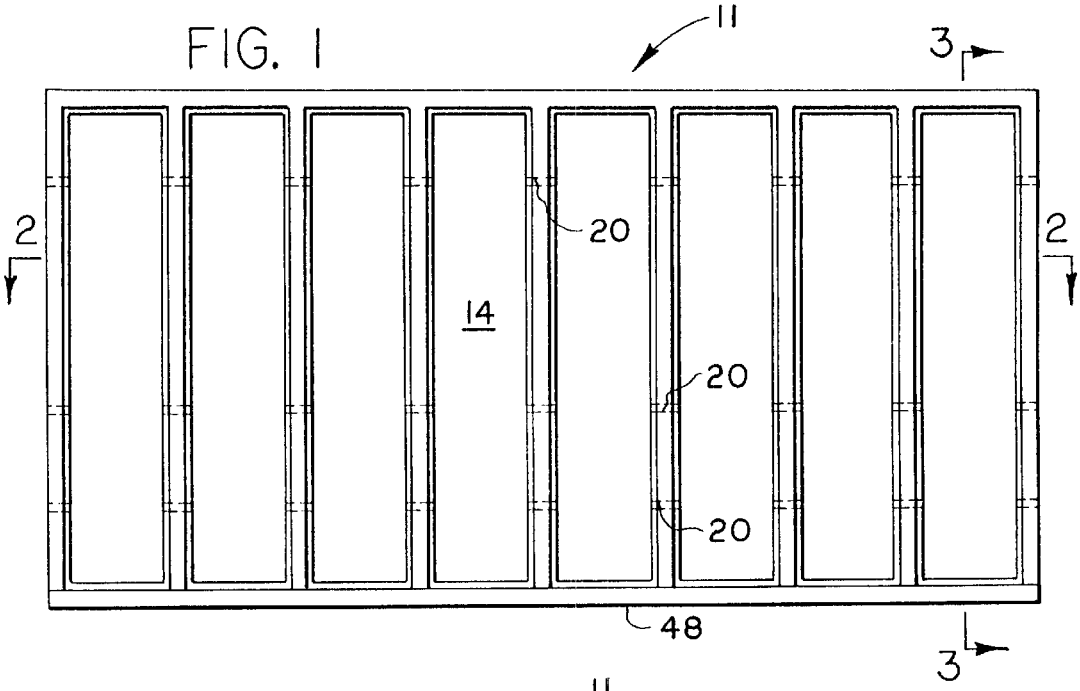
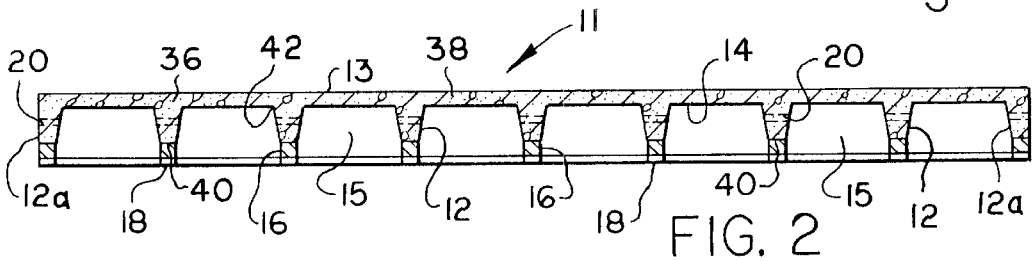
FIG. 2
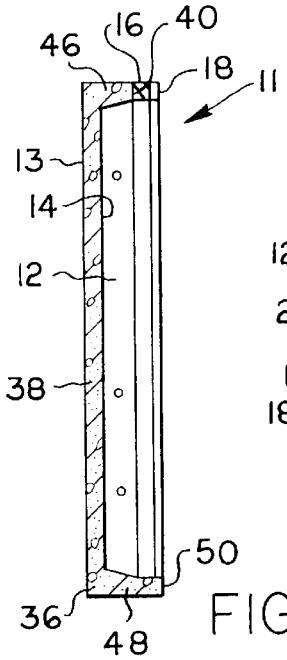
FIG. 3
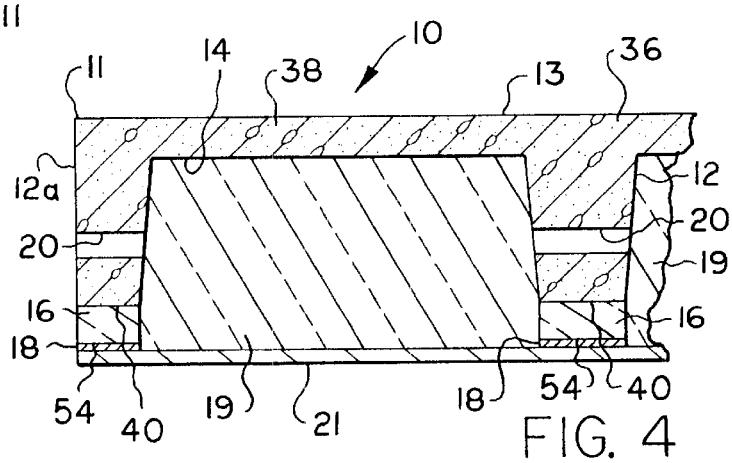
FIG. 4

METHOD OF FORMING A PREFABRICATED WALL PANEL

This is a divisional of application Ser. No. 08/508,722 filed on Jul. 28, 1995, now U.S. Pat. No. 5,956,911, which is a continuation-in-part of application Ser. No. 08/015,783, filed Feb. 10, 1993, now abandoned, the disclosures of which are hereby incorporated herein by reference.

The present invention relates generally to the construction of walls such as basement walls utilizing pre-formed panels. Examples of pre-formed wall structures are found in U.S. Pat. Nos. 3,435,581; 4,671,032; 5,055,252; 4,570,398; 4,605,529; 4,751,803; and 4,934,121. U.S. Pat. 2,634,601 discloses an insulated building wall construction.

Improvements in pre-cast concrete technology and cost efficiency requirements have resulted in an increase in the use of pre-cast foundation and structural walls. Contrary to traditional poured-in-place foundation walls or brick or stone variations of the same, pre-cast concrete walls are formed as a series of wall portions at a central location and transported to a building site where the wall portions are jointed in erecting the wall.

Improvements in both the functional and aesthetic performance of pre-cast walls have further increased the desirability of their use especially in construction of large commercial or industrial buildings such as office towers, schools, and manufacturing facilities. Cost efficiencies, as well as ease and speed of construction and maintenance, together with improvements in the insulating and energy efficiency of pre-cast concrete walls have also contributed to substitution of pre-cast concrete construction for more traditional methods.

However, pre-cast concrete walls such as those disclosed in the above patents have continued to suffer deficiencies in their insulating capabilities. For example, a pre-cast concrete wall may typically include an outer wall and a series of spaced "ribs" perpendicular to the wall and extending inwardly a number of inches to act as wall studs for supporting the inner wallboard. Insulation is provided in the "voids" bounded by the outer wall, the perpendicular ribs or studs, and the affixed inner wallboard. Typically, the wallboard is nailed directly to the pre-cast concrete ribs, which thereby act as bridges between the outer pre-cast wall and the inner wallboard. Such bridges are, of course, formed of pre-cast concrete and are therefore undesirably conductors of heat or cold. Accordingly, notwithstanding any insulation interposed in the "voids", cold or heat may travel these bridges or paths between the outer wall and inner wallboard thereby resulting in environmental and energy inefficiencies. Moreover, when insulation is applied only as a layer along the outer wall thus not filling the voids entirely, heat and cold conducted along the ribs is able to escape into the "voids" unimpeded leading to further insulating problems and inefficiencies.

Accordingly, it is an object of the present invention to improve the insulating capability of prefabricated walls.

It is a further object of the present invention to provide such an improved prefabricated wall which is rugged, reliable, and easy to erect.

It is yet another object of the present invention to provide prefabricated panels for such a wall which are easy and inexpensive to construct.

In accordance with the present invention, a prefabricated wall panel comprises a unitary combination of a member having a generally planar portion which has an outer surface which defines the outer surface of the erected wall and a plurality of rib portions integral with the planar portion and extending from the inner surface of the planar portion thereby defining voids therebetween for receiving insulation. The wall panel further comprises insulating material attached, as strips or otherwise suitably attached, to the edges of the rib portions which are remote from the planar portion. A nailer strip, which may be a screw nailer or other suitable means, is applied to each insulating material strip. After the prefabricated wall panels are installed and insulation is placed in the voids, wallboard defining the inner surface of the wall is attached to the nailers to complete the wall construction. Such a prefabricated panel is thus provided to eliminate conductive pathways between the rib portions and the wallboard so that greater insulative capability may be achieved in a panel from which a wall may be easily yet reliably and inexpensively erected.

The above and other objects, features, and advantages of the present invention will be apparent in the following detailed description of the preferred embodiments thereof when read in conjunction with the accompanying drawings wherein the same reference numerals denote the same or similar parts throughout the several views.

BRIEF DESCRIPTION OF THE DRAWINGS

FIG. 1 is a side elevation view of one of a series of panels for forming a pre-cast concrete wall in accordance with the present invention.

FIG. 2 is a sectional view thereof taken along lines 2—2 of FIG. 1.

FIG. 3 is a sectional view thereof taken along lines 3—3 of FIG. 1.

FIG. 4 is an enlarged sectional view similar to that of FIG. 2 of a portion of a wall constructed with the panel.

DETAILED DESCRIPTION OF THE PREFERRED EMBODIMENTS

Figure 5:
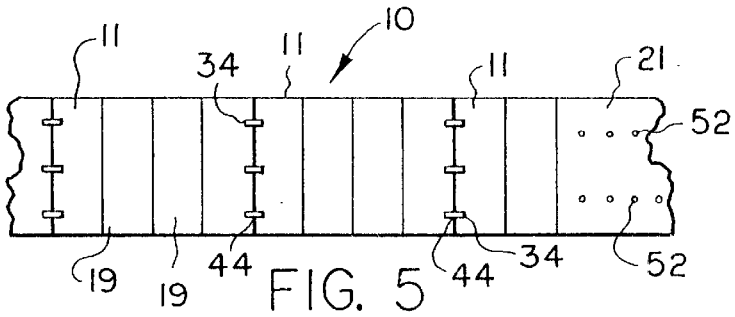
FIG. 5 is a schematic side elevation view of the wall.

Referring to FIG. 5, there is illustrated generally at 10 a wall for a basement or the like which is formed of a series of prefabricated or pre-formed panels 11 which are transported to the construction site and placed in a side-to-side abutting relationship and connected to each other by bolts 34 or other suitable means. The terms "prefabricated" or "pre-formed", as used herein and in the claims, refer to panels which have been formed at a first site and then transported to a second site for the building of a wall therewith. A wall built with such a prefabricated panel is thus distinguished from a poured-in-place wall wherein the wall is formed on-site. Each panel 11 comprises a unitary combination of elements, which will be described hereinafter, to afford ease of wall construction while affording a desired insulative capability. As used herein and in the claims, the term "panel" is meant to refer to one of a series of units or unitary combinations for construction of a wall.

A panel 11 comprises a member 36 which is an integral or monolithic load-bearing structure pre-cast of concrete or otherwise suitably composed of a suitable material which would be considered equivalent thereto. The member 36 includes a generally planar vertical laterally extending rectangular portion 38 having outer and inner surfaces 13 and 14 respectively, the outer surface 13 serving as the outer surface of the wall 10 constructed therewith. Integrally connected to and formed with the planar portion 38 are a plurality of laterally spaced vertical rib portions 12 which extend from the inner surface 14 and which terminate at edges 40 which are remote from the planar portion 38, i.e., an edge 40 is opposite to the location 42 of joinder of a rib portion 12 with the planar portion 38. As used herein and in the claims, the term "remote" is understood to be with reference to a laterally extending planar portion of a panel. The rib portions 12 preferably extend over the entirety of the panel height and perpendicular to the planar portion 38. A pair of laterally outer rib portions 12*a* serve to define the sides of the panel 11. These rib portions 12*a* have apertures, illustrated at 44, through which bolts 34 are inserted for connecting the panels 11 together at the wall construction site. The member 36 also includes upper and lower transverse or horizontal rib portions 46 and 48 respectively which are also formed integrally with the planar portion 38 and with the vertical rib portions 12 and which define the upper and lower edges respectively of the panel 11. The lower rib portion 48, which in the wall 10 is in contact with the ground, extends inwardly beyond the remote edges 40 of the other rib portions 12 and 46 to terminate at remote edge 50 which is co-extensive with the inner surface of the unitary panel 11. If a panel 11 were constructed to rest on top of another panel so as to be above the ground, then lower rib portion 48 would desirably be formed to be similar to the other rib portions and provided with insulative capability, as hereinafter discussed. The integral pre-cast concrete member 36 may be suitably reinforced with rebar or the like, similarly as shown at 56 in FIG. 8. Rib portions 12 may contain through-holes 20 for routing of electrical wiring, conduit, and the like.

After the panels 11 are placed in position at the wall construction site, caulking applied therebetween for sealing, and the panels suitably connected together, individual masses of suitable insulation 19 are disposed in the voids or gaps 15 defined between or bounded by the respective rib portions 12, 46, and 48 and the planar portion 38. These masses of insulation 19 may desirably be fiberglass or other suitable insulation and preferably fill the entire space of each void 15. After the insulation 19 is installed, wallboard 21 is then suitably affixed, as described hereinafter, by suitable attachment means, illustrated at 52, such as, for example, nails or screws to finish the wall 10.

Concrete is considered to be a good conductor of heat and cold and therefore a poor insulator. If the wallboard 21 were connected directly to the rib edges 40, there would be pathways through the rib portions for conduction of heat and cold which would reduce the insulative capability of the panels. In order to eliminate such pathways so as to achieve an improved insulative capability, in accordance with the present invention, individual strips of insulating material 16 such as, for example, expanded polystyrene foam are attached to the edges 40 by use of adhesive, nails, or other suitable means. These insulating material strips 16 suitably have a width and height equal substantially to that of the respective edges 40 to which they are joined and extend inwardly therefrom to terminate at inner remote edges 54.

Nailer boards 18 in the form of individual wooden strips also having substantially the same width and height as that of the respective rib edges 40 or other suitable means are adhesively or otherwise suitably attached to the edges 54 of the insulation strips 16. Thus, the insulation strips 16 and nailers 18 may be said to cap the inner edges 40 of the ribs 12 and 46.

Since wood or other material of which the nailers 18 may be composed may be considered to be conductors of heat and cold, the nailers 18 are preferably affixed to the insulation strips 16 so as to be spaced from the respective rib portions 12 and 46 so as not to form a conduction pathway to the wallboard. However, it should be understood that there may be a minimal conduction pathway between a rib and a nailer due, for example, to the way the nailer is affixed to the insulation strip, and such an embodiment is meant to come within the scope of the present invention. Such an embodiment is illustrated in FIGS. 10 to 14.

The wallboard 21 may be suitably attached to the wooden nailers 18 with the attachment means 52 being nails or tacks or may be alternatively adhesively or otherwise suitably attached with the individual masses of insulation 19 and the individual strips of insulation 16 provided to effectively insulate the wallboard 21 from the concrete members 36. The unitary combination of the integrally pre-cast concrete members 36, insulation strips 16, and nailers 18 is provided to allow ease of wall construction inexpensively while achieving more effective insulative capability.

Figure 6:
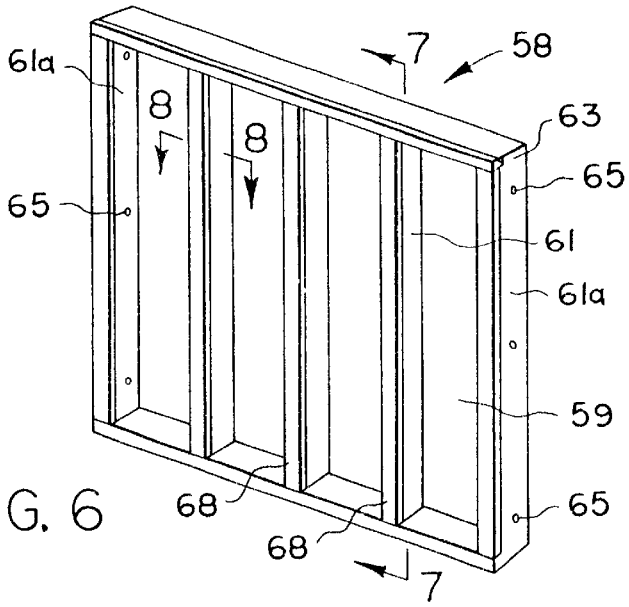
FIG. 6 is a perspective view of a panel in accordance with an alternative embodiment of the present invention.
Figure 7:
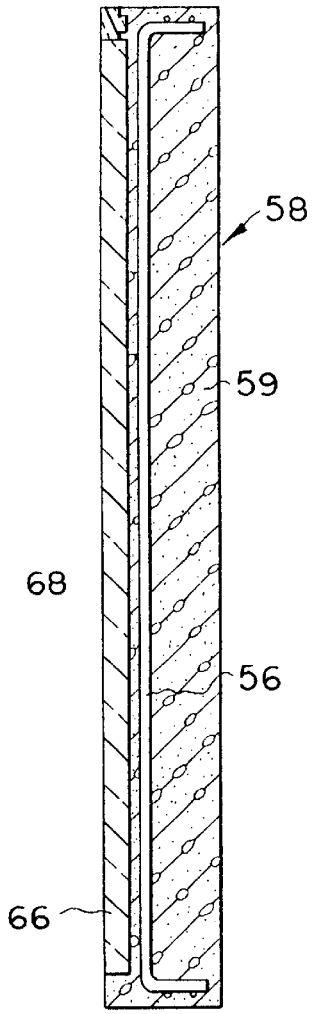
FIG. 7 is an enlarged sectional view of the panel of FIG. 6 taken along lines 7—7 of FIG. 6.
Figure 8:
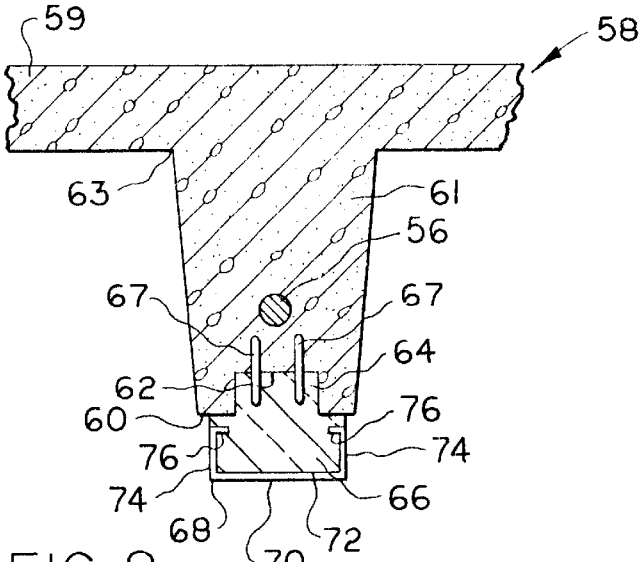
FIG. 8 is an enlarged partial sectional view thereof taken along lines 8—8 of FIG. 6.

Referring to FIGS. 6, 7, and 8, there is illustrated generally at 58 a unitary wall panel in accordance with an alternative embodiment of the present invention. In this embodiment, which includes a pre-cast concrete member 63 having planar portion 59 similar to planar portion 38 and which is similar to wall panel 11 except as described hereinafter, a plurality of perhaps 5 laterally spaced rib portions 61 have remote edges 60 which have centrally-disposed recesses, illustrated at 62, extending over the rib height which recesses receive mating portions 64 of individual insulation strips 66 for more secure attachment thereof. The insulation strips 66 are attached to the rib portions 61 by means of vertically spaced pairs of plastic nails or pins 67 which are stabbed into the strips 66 along the height thereof, and the concrete for the member 63 is cast about the pins 67. Panels 58 are attached to each other to form a wall by means of perhaps 3 vertically spaced apertures, illustrated at 65, in each of the outer ribs 61*a* for receiving fasteners such as bolts 34.

Wood, when used as a nailer, may have a tendency to deflect. In order to eliminate such deflection as well as to achieve a good finish to the panels for a good appearance, in accordance with the alternative embodiment, the nailer, illustrated at 68 in FIG. 8, is composed of steel or other suitable metal which may receive screws for attachment of wallboard. By the term "nailer" is thus meant, for the purposes of this specification and the claims, a member composed of any suitable material to serve as a means for attaching wallboard by any suitable means including screws and adhesive as well as nails. The nailer 68 is in the form of a flat elongate plate which extends over the height of the rib 61 and which is formed to have a central portion 70 which extends across the width of the insulation strip inner edge 72, a pair of side portions 74 which are generally normal to portion 70 and which extend from portion 70 along the side edges of insulation strip 66 toward rib edge 60, and a pair of edge portions 76 which extend from side portions 74 in a direction generally parallel to central portion 70 into the insulation material 66 to provide a secure attachment to the insulation strip 66. In order that a conduction pathway is not formed, the edge portions 76 are preferably disposed to be spaced from the concrete rib portion 61. The steel nailer 68 may additionally be adhesively or otherwise suitably attached to the insulation strip 66, and the cement may be poured face down over the insulation strip 66 with the nailer 68 attached and inserted pins 67 to form the desired unitary panel combination for ease of wall construction inexpensively.

Figure 9:
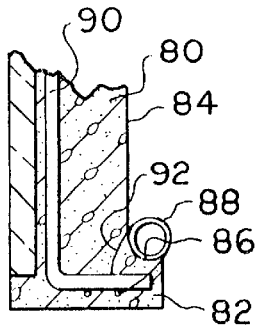
FIG. 9 is a partial sectional view, similar to that of FIG. 7, illustrating an alternative embodiment thereof.

Referring to FIG. 9, there is illustrated an alternative embodiment of the panel wherein the planar portion 80, which is otherwise similar to planar portions 38 and 59, is formed to have a foot portion 82 which extends outwardly from the outer surface 84 of planar portion 80 at the bottom and along the length thereof. The upper surface of portion 82 is suitably shaped to provide a ledge 86 for receiving an under drain pipe portion 88. The pipe portion 88 is anchored to laterally spaced rebar members 90 along the length thereof by suitable means such as hose clamps, illustrated schematically at 92, before the concrete pour to form the panel member. Thus, the under drain pipe portion 88 is incorporated as part of the unitary combination of the wall panel so as to alleviate the need to install an under drain separately thereby adding to the ease of wall construction. After installation of the panels, the pipe portions 88 on the respective panels are connected to each other and to sump in a conventional manner.

A panel in accordance with the present invention may, for example, have a height of perhaps about 8 to 10 feet, a width of perhaps about 8 to 16 feet, and a depth of perhaps about 10½ inches, with the foot portion 82 extending outwardly perhaps about 4 inches to accommodate a 4 inch under drain pipe portion. The planar portion may have a thickness of perhaps about 2 inches. The insulation strip 66 may have an overall width and depth of perhaps about 3 inches and 2½ inches respectively, with the portion 64 having a width and depth of perhaps about 2 inches and 1 inch respectively. The nailer plate 68 may perhaps be 25 gage steel and may be adhesively attached to the insulation strip by a plate adhesive sold by AMF Corp. The reinforcement bar 56 may be spaced perhaps about 1 inch from the insulation strip 66. The concrete member may be further reinforced with flash/fiber and may be pre-cast at perhaps about 5000 psi to provide increased strength. The nailer edges 76 may be spaced from the rib edge 60 a distance of perhaps about ½ inch.

Figure 10:
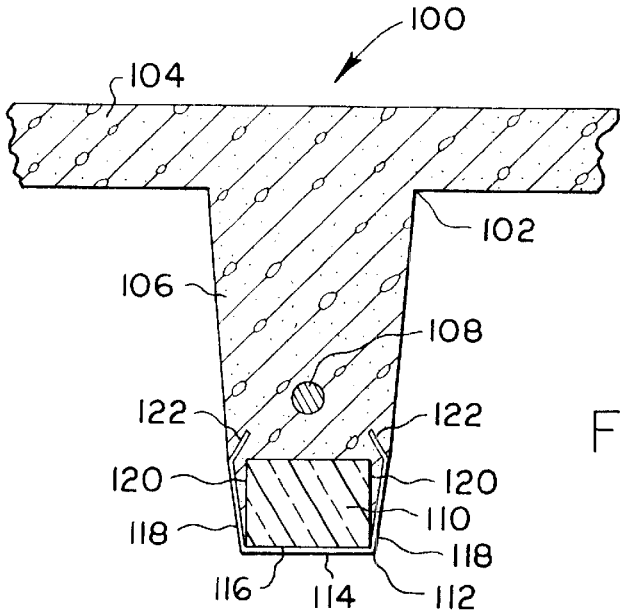
FIG. 10 is a view similar to that of FIG. 8 of a portion of a panel in accordance with another alternative embodiment of the present invention.
Figure 11:
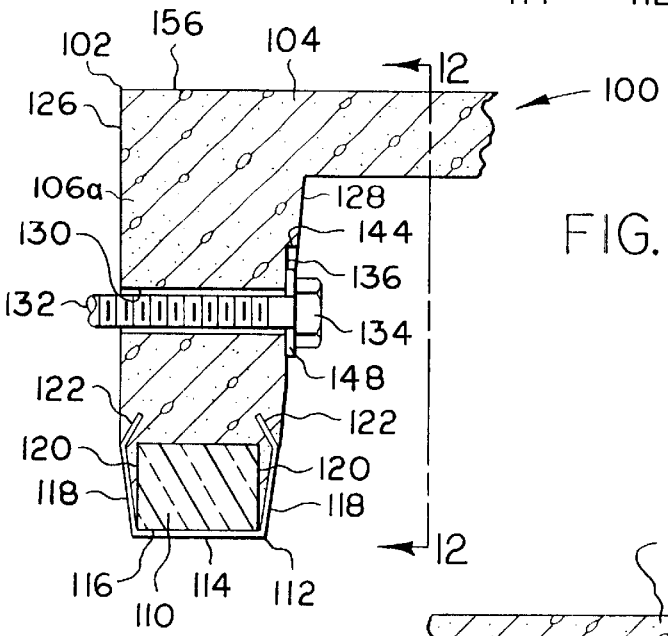
FIG. 11 is a view similar to that of FIG. 8 of another portion of the panel of FIG. 10.
Figure 12:
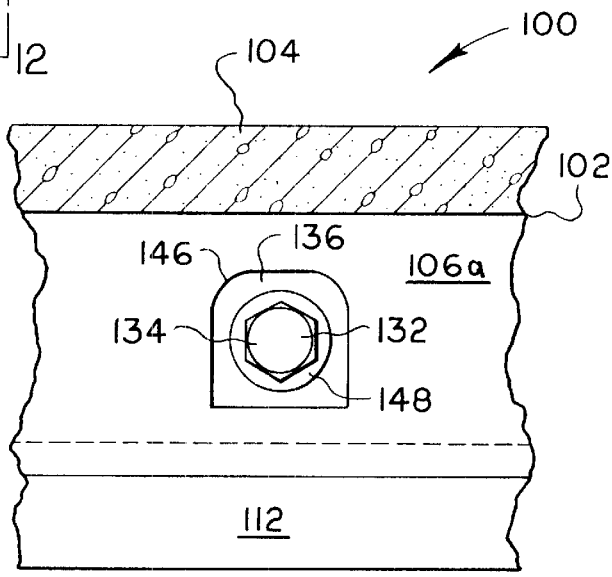
FIG. 12 is a sectional view thereof taken along lines 12—12 of FIG. 11.

Referring to FIGS. 10 to 14, there is illustrated generally at 100 an alternative embodiment of a unitary wall panel, which is similar to wall panels 11 and 58, except as described hereinafter and shown in the drawings. Wall panel 100 includes a pre-cast concrete member 102 having a planar portion 104 and a plurality of laterally spaced rib portions 106, one of which is shown in FIG. 10, extending therefrom. An outer rib portion 106a is shown in FIGS. 11 and 12. The ribs 106 are suitably reinforced with rebar 108.

Unitarily attached to the remote ends of the ribs 106 are individual strips 110 of insulation material, which may be similar to insulation strips 16, and steel (or other suitable metal) nailers 112 for receiving screws or other suitable means for attachment of wallboard, the nailer 112 and insulation strip 110 extending over the height of the respective rib 106. Each insulation strip 110 is generally rectangular in cross-section. The nailer 112 is bent or otherwise suitably formed to generally surroundingly engage or tightly nest the insulation strip 110 and is anchored at its longitudinal edges in the concrete member 102 to hold itself and the insulation strip 110 securely attached to the remote end of the respective rib 106. More specifically, the nailer 112 has a central portion 114 which engages or extends alongside the remote or inner edge 116 of the insulation member 110 and may, if desired, be adhesively attached thereto, a pair of portions 118 which extend from the central portion 114 alongside the sides 120 of the insulation portion 110, and a pair of edge portions 122 which extend therefrom outwardly (toward the planar portion 104) and toward each other into the respective rib 106 to be anchored therein.

Figure 13:
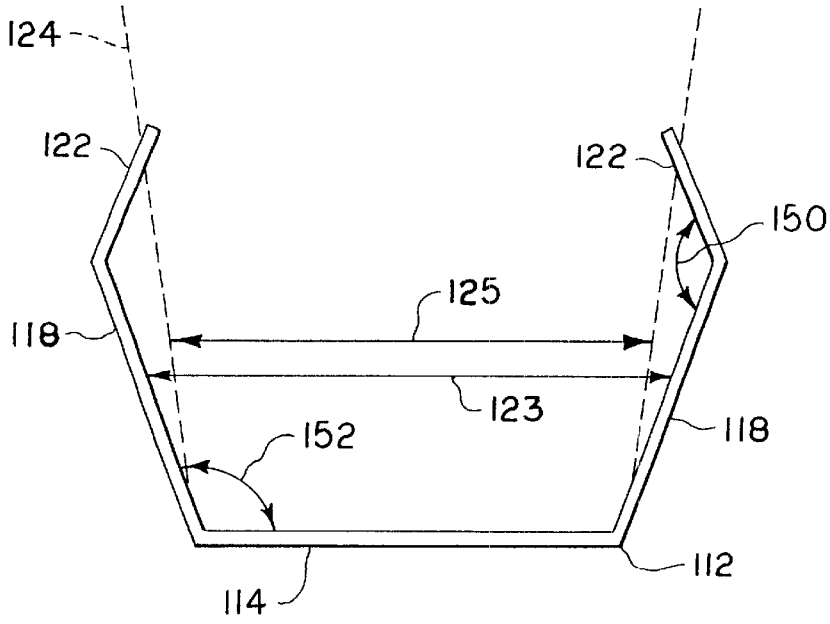
FIG. 13 is an end view of the nailer for the panel of FIGS. 10 and 11 in a relaxed condition and shown before insertion into a mold, illustrated by dashed lines, for formation of the panel.
Figure 14:
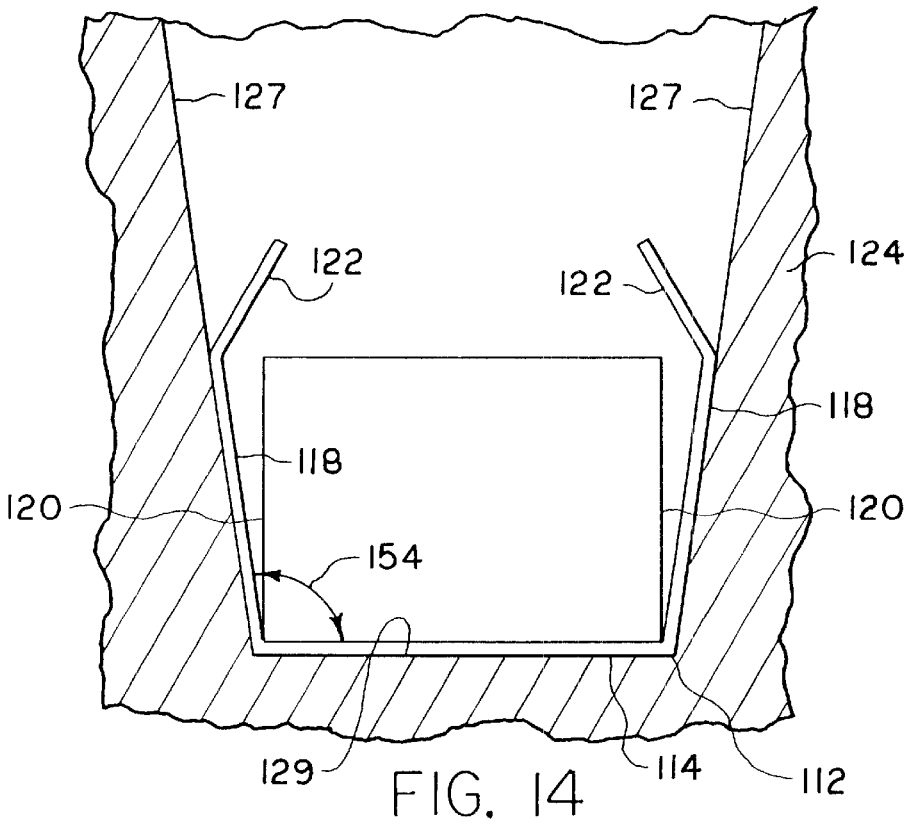
FIG. 14 is an end view of the nailer and foam insulation in the mold, shown partially in section, in position for pouring cement therein to form the panel.

With the insulation strip 110 nested therein, the nailer 112 is inserted into a suitable mold, illustrated at 124 in FIGS. 13 and 14. Cement material is then poured therein to cast the concrete member 102 thereto with the nailer edge portions 122 anchored therein. Thus, the panel 100 may be inexpensively produced by inserting the nailers 112 and insulating strips 110 and pouring.

Unless there is a tight fit between the nailer side portions 118 and the respective walls of the mold 124, cement may get therebetween to result in an aesthetically displeasing appearance to the finished panel 100. In addition, liquid may bleed from the cement material into the space therebetween so that consolidation of the concrete casting may not be as good as desired. In order to provide such a tight fit, in accordance with the present invention, the nailer 112 is composed of spring steel (or other suitable spring metal or composite) which, when it is in its relaxed condition, the side portions 118 are spaced apart, as illustrated at 123 in FIG. 13, a greater distance than the respective mold wall portions are spaced apart, as illustrated at 125, at the same distance from the central portion 114 and mold bottom 129 respectively over the length of the side portions 118. Stated another way, the angle, illustrated at 152, which each side portion 118 forms with the central portion 114 is greater than the angle, illustrated at 154, which each mold wall 127 forms with the mold bottom wall 129 when the nailer 112 is in a relaxed condition prior to insertion into the mold 124. As a result, as the nailers are inserted into the mold 124, the tapered mold walls draw the nailer side portions 118 inwardly and more tightly against the insulation strip 110, the nailer side portions 118 being biased to sealingly bear against the respective mold walls 127 so as to prevent the aggregation of material therebetween so that an aesthetically pleasing appearance as well as good consolidation of the casting may be obtained.

Normally, at least one of the mold walls for each rib 106 is tapered to allow the cast panel 100 to be removed from the mold 124. As a result, although the outer wall 126 of the outer rib 106*a* may be squared or non-tapered as shown to achieve a squared fit between panels, the inner wall 128 thereof may be tapered to allow for easy removal of the cast panel from the mold 124.

After the panel is cast, a number of perhaps 3 vertically spaced apertures, one of which is illustrated at 130, are suitably formed in each of the outer ribs 106*a* of the cast concrete member 102 for receiving bolts 132 for attaching the panel to another panel. However, the tapered wall 128 may not allow suitable interface between the bolt head 134

(or nut). In order to allow a suitably squared interface therebetween so as to achieve a full strength attachment, in accordance with the present invention, means are provided for presenting a squared surface (non-tapered surface which is normal to the axis of aperture 130) for receiving the bolt head 134 and its associated washer 148 against the tapered wall 128. It should be noted that only a portion of bolt 132 is shown and that the bolt 132 should be long enough to engage apertures 130 in ribs 106*a* of two panels 100 being connected together, and a nut and washer applied to the other end. As used herein and in the claims, the term "head" for a bolt is meant to also apply to a nut for a bolt and is also meant to include a washer therewith. Such a means for presenting a squared surface is suitably provided by casting or otherwise suitably forming in tapered wall 128 around the entrance to the aperture 130 a recess, illustrated at 136, the surface of which is substantially squared or non-tapered so as to be substantially normal to the axis of the aperture 130 for squarely engaging the bolt head 134 (or washer 148 therefor). The casting of the recess 136 may be achieved by suitably providing a cam wedge-shaped protrusion on the corresponding mold wall 127. The corners 146 of the upper or deeper edge of the recess are rounded.

For the purposes of illustration and not for purposes of limitation, the following are exemplary dimensions. The planar portion 104 may have a thickness of perhaps about 2 inches. Each rib 106 may extend therefrom (including the insulation strip 110 and nailer 112) a distance of perhaps about 8½ inches. The insulation strip 110, which may perhaps be expanded polystyrene foam, may have a width of perhaps about 2¾ inches and a depth of perhaps about 2 inches. The nailer 112 may be composed of perhaps 25 gage galvanized spring steel. The width of its central portion 114 may perhaps be about 2¾ inches plus or minus ⅛ inch. Each of the side portions 118 has a width of perhaps about 2 inches, and each of the edge portions 122 has a width of perhaps about 1 inch. The angle, illustrated at 150, between each side portion 118 and the respective edge portion 122 may perhaps be about 140 degrees. When the nailer 112 is in a relaxed condition prior to insertion into the mold 124, the angle 152 between each side portion 118 and the central portion 114 may perhaps be about 102 degrees, which is greater than the angle 154 of perhaps about 96 degrees between the corresponding mold side wall 127 and its bottom wall 129. The centers of each of the apertures 130 may be spaced perhaps about 5¼ inches from the inner surface 156 of the planar portion 104. Apertures 130 may have diameters of perhaps about 1 inch for receiving ¾ inch heavy hex bolts and ¾ inch washers. The width and height of the recess 136 may each be perhaps about 2⅞ inches, and its corners 146 may be rounded at a radius of perhaps about 1 inch. The recess 136 may taper at an angle of perhaps about 3 degrees from a depth at upper edge 144 of perhaps about 5/32 inch.

The panels of the present invention are thus provided to achieve improved insulation while allowing ease of construction inexpensively of a wall which may be reliable yet may be finished in perhaps a day.

While the invention has been described in detail herein, it should be understood that various modifications can indeed be made to the invention as disclosed herein, and such modifications are meant to come within the scope of the present invention as claimed in the appended claims.

What is claimed is:

1. A method of forming a wall panel of a settable material having a plurality of rib portions, comprising the steps of:

inserting a spring member into a mold such that, as the spring member is inserted into the mold, mold walls of the mold draw side portions of the spring member inwardly, the spring member having a first relaxed shape prior to insertion into the mold and a second compressed shape after insertion into the mold, the side portions of the spring member providing an outward force against the mold walls after insertion of the spring member into the mold such that the side portions of the spring member sealingly bear against the mold walls to prevent leakage of the settable material between the mold and the spring member, adding the settable material to the mold to form the wall panel such that the spring member is unitarily attached to one of the rib portions of the wall panel, and allowing the settable material to set.

2. The method of claim 1, wherein the settable material is concrete.

3. The method of claim 1, further comprising the step of inserting an insulation strip in the spring member prior to adding the settable material.

4. The method of claim 1, wherein the spring member forms a remote rib portion of the wall panel extending from a generally planar portion of the wall panel.

5. The method of claim 1, wherein the spring member forms a wallboard attachment means.

6. The method of claim 1, wherein the spring member is steel.

7. The method of claim 1, wherein the spring member is tapered.

8. A method of forming a wall panel of a settable material having a plurality of rib portions, comprising the steps of:

providing a spring member, deforming the spring member from a first relaxed shape to a second compressed shape by inserting the spring member into a mold such that mold walls of the mold draw side portions of the spring member inwardly, the side portions of the spring member providing an outward force against the mold walls after insertion of the spring member into the mold such that the side portions of the spring member sealingly bear against the mold walls to prevent leakage of the settable material between the mold and the spring member, adding the settable material to the mold to form the wall panel such that the spring member is unitarily attached to one of the rib portions of the wall panel, and allowing the settable material to set.

9. The method of claim 8, wherein the settable material is concrete.

10. The method of claim 8, further comprising the step of inserting an insulation strip in the spring member prior to adding the settable material.

11. The method of claim 8, wherein the spring member forms a remote rib portion of the wall panel extending from a generally planar portion of the wall panel.

12. The method of claim 8, wherein the spring member forms a wallboard attachment means.

13. The method of claim 8, wherein the spring member is steel.

14. The method of claim 8, wherein the spring member is tapered.

* * * * *